United States Patent [19]

Brickhouse

[11] Patent Number: 4,582,233

[45] Date of Patent: Apr. 15, 1986

[54] CLOTHES HANGER FOR HANDICAPPED PERSONS

[76] Inventor: Todd Brickhouse, 76 Waldo St., Copiague, N.Y. 11726

[21] Appl. No.: 719,366

[22] Filed: Apr. 3, 1985

[51] Int. Cl.[4] ..... A47J 51/082; A47J 51/09

[52] U.S. Cl. ..... 223/88; 223/92; 211/119; D6/317; D6/319

[58] Field of Search ..... 223/85, 88, 92; 211/119; D6/317, 318, 319

[56] References Cited

U.S. PATENT DOCUMENTS

| | | | |
|---|---|---|---|
| D. 140,337 | 2/1945 | Hill | D6/319 |
| D. 173,676 | 12/1954 | Perrin | D6/317 |
| D. 219,692 | 1/1971 | Kufchock | D6/319 |
| 749,455 | 1/1904 | Shoeneman | 223/88 |
| 924,763 | 6/1909 | Grant | 223/88 |
| 1,836,968 | 12/1931 | Herzog | 223/88 |
| 2,593,356 | 4/1952 | Smith | 211/119 |
| 2,998,903 | 9/1961 | Day | 223/92 X |
| 3,225,980 | 12/1965 | Wieckmann | 223/88 X |

FOREIGN PATENT DOCUMENTS

| | | | |
|---|---|---|---|
| 1014935 | 6/1952 | France | 223/88 |
| 515433 | 12/1939 | United Kingdom | 223/88 |

OTHER PUBLICATIONS

"Fairy", Garment Hangers, 1936, The All-Styles Hanger Company, Inc., New York, N.Y., p. 10.

*Primary Examiner*—Robert R. Mackey
*Attorney, Agent, or Firm*—Brumbaugh, Graves, Donohue & Raymond

[57] ABSTRACT

A wire clothes hanger is provided with a U-shaped handle portion extending downwardly from the hanger to enable use of the hanger in a conventional closet by handicapped persons confined to a wheelchair.

4 Claims, 1 Drawing Figure

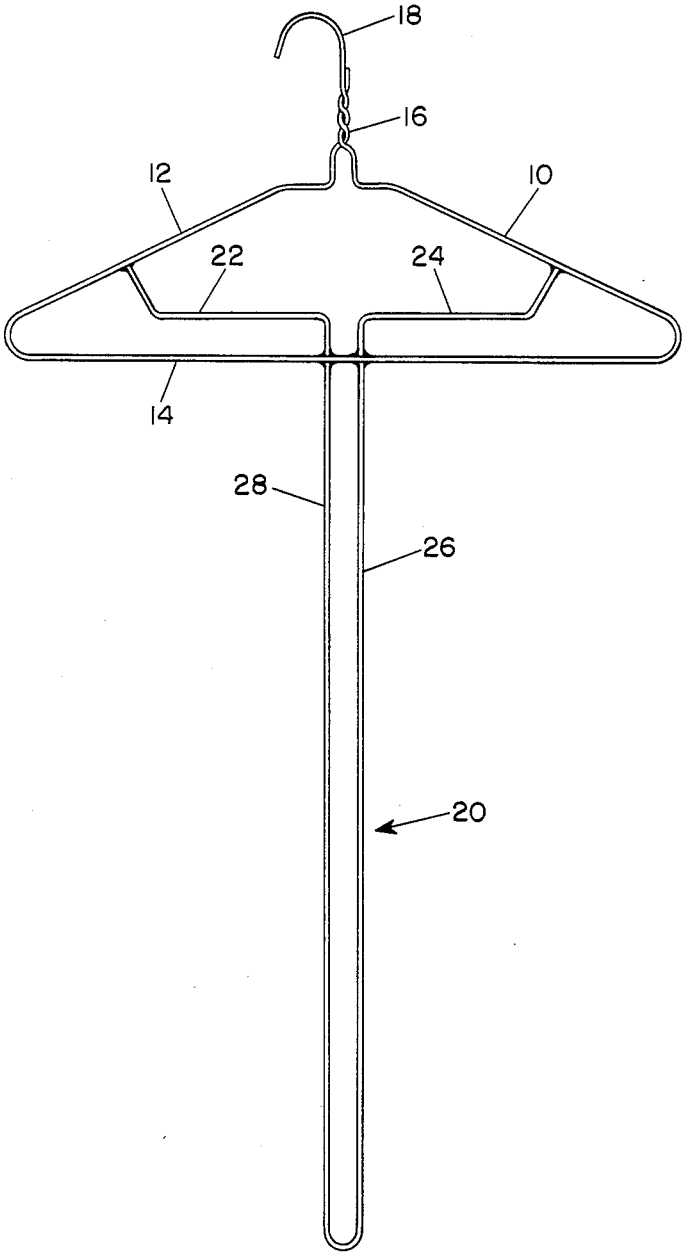
18
16
12
10
22
24
14
28
26
20

CLOTHES HANGER FOR HANDICAPPED PERSONS

BACKGROUND OF THE INVENTION

This invention relates to a new and improved clothes hanger particularly adapted for use by handicapped persons, such as those confined to a wheelchair, who cannot easily reach the bar in an ordinary clothes closet for purposes of hanging up clothing.

SUMMARY OF THE INVENTION

In accordance with the present invention there is provided a clothes hanger formed out of wire and having a generally triangular clothes bearing portion with an upward extending hook. The clothes bearing portion has slanted clothes bearing wire portions extending outwardly and downwardly from the hook and joined by a horizontal wire portion. In accordance with the invention, there is provided a handle portion comprising a U-shaped wire which is joined to the clothes bearing wire portions at its upper end and joined to the horizontal wire portion and extending downwardly from the horizontal wire portion in a direction opposite to the hook to form a handle.

In a preferred embodiment of the invention, the U-shaped wire is joined approximately mid-way along the clothes bearing wire portions. The U-shaped wire preferably has horizontal portions between the clothes bearing wire portions and the horizontal wire portion for supporting a pair of slacks. The handle portion is preferably made of heavy gauge wire to provide rigidity, and the entire hanger may be coated with a plastic coating to prevent rust.

BRIEF DESCRIPTION OF THE DRAWING

The drawing shows a clothes hanger in accordance with the present invention.

DESCRIPTION OF THE PREFERRED EMBODIMENT

Referring to the drawing, there is shown a clothes hanger in accordance with the invention which includes a conventional wire clothes hanger having clothes bearing wire portions 10 and 12 connected on the lower end by horizontal wire portion 14 and twisted together at 16 at the upper end. One of the wire ends is shaped to form a hook 18. What has been described thus far is essentially a conventional steel wire clothes hanger.

In accordance with my invention, there is provided a handle 20 which is formed of a generally U-shaped wire, preferably of heavier gauge steel than the wire used to form a conventional coat hanger, for example, approximately 3/16 to $\frac{1}{4}$ inch diameter. The U-shaped wire has parallel portions 26 and 28, which extend approximately 22 inches below horizontal wire portion 14 at $\frac{1}{2}$ inch spacing forming an extended handle that can be used to place or remove the hanger from a conventional-height bar by a person seated in a wheelchair. Upper sections 22 and 24 of the U-shaped wire are joined, for example by welding, to clothes bearing wire portions 10 and 12 approximately mid-way along the wire, and joined to horizontal wire portion 14 at their respective crossing points. Wire sections 22 and 24 include horizontal portions between clothes bearing wire portions 10 and 12 and horizontal wire portion 14, which can conveniently support a folded pair of slacks.

In addition to providing a place for supporting slacks, wire portions 22 and 24 provide extra support for clothes bearing wire portions 10 and 12 at their mid point, thereby strengthening the hanger for long usage.

In order to avoid rusting of the article during a long duration of use, a plastic coating may be provided over the entire hanger.

While there has been described what is believed to be the preferred embodiment of the invention, those skilled in the art will recognize that other and further modifications may be made thereto without departing from the spirit of the invention, and it is intended to claim all such changes and modifications as fall within the scope of the invention.

I claim:

1. A clothes hanger comprising a generally triangular wire clothes bearing portion having an upwardly extending hook, said clothes bearing portion having slanted clothes bearing wire portions extending outwardly from said hook and joined by a horizontal wire portion, and a handle portion comprising a generally U-shaped wire joined to said clothes bearing wire portions at its upper ends, joined in said horizontal wire portion and extending downwardly in a direction opposite to said hook to form a handle, said U-shaped wire having upper clothes bearing portions extending horizontally between said slanted clothes bearing wire portions and said horizontal wire portion.

2. A clothes hanger as specified in claim 1 wherein said U-shaped wire is joined to said clothes bearing wire portions at approximately the mid-point of said clothes bearing wire portions.

3. A clothes hanger as specified in claim 1 wherein said U-shaped wire is fabricated of heavier gauge wire material than the remaining portions of said hanger.

4. A clothes hanger as specified in claim 1 further including a plastic coating on said wires.

* * * * *